US010087642B2

(12) United States Patent
Montoya

(10) Patent No.: US 10,087,642 B2
(45) Date of Patent: Oct. 2, 2018

(54) SCREEN GRID INSULATED CONCRETE FORM PANEL SYSTEM AND METHOD FOR CONSTRUCTION AND BUILDING

(71) Applicant: Robert Montoya, Albuquerque, NM (US)

(72) Inventor: Robert Montoya, Albuquerque, NM (US)

( * ) Notice: Subject to any disclaimer, the term of this patent is extended or adjusted under 35 U.S.C. 154(b) by 0 days.

(21) Appl. No.: 15/401,309

(22) Filed: Jan. 9, 2017

(65) Prior Publication Data

US 2017/0198475 A1 Jul. 13, 2017

Related U.S. Application Data

(60) Provisional application No. 62/277,122, filed on Jan. 11, 2016.

(51) Int. Cl.
*E04G 11/06* (2006.01)
*E04B 2/86* (2006.01)

(52) U.S. Cl.
CPC ..... *E04G 11/06* (2013.01); *E04B 2/8611* (2013.01); *E04B 2002/867* (2013.01); *E04B 2002/8682* (2013.01); *E04B 2103/02* (2013.01)

(58) Field of Classification Search
CPC ..... E04B 2/86; E04B 1/762; E04B 2103/02; E04B 2002/8682; E04G 11/06; E04C 5/06
USPC ..... 52/309.8, 309.9, 309.12, 309.14, 309.17
See application file for complete search history.

(56) References Cited

U.S. PATENT DOCUMENTS 3,382,637 A * 5/1968 Longinotti ..... E04B 5/40 411/177
3,788,020 A * 1/1974 Gregori ..... E04B 2/54 52/309.12
4,924,641 A * 5/1990 Gibbar, Jr. ..... E04B 2/8652 52/204.1
5,609,934 A * 3/1997 Fay ..... B32B 3/04 156/308.2
5,640,817 A * 6/1997 Bos ..... E01F 8/0017 256/24
2001/0020351 A1 9/2001 Alvaro
2002/0092251 A1 7/2002 Alvaro et al.
2004/0016194 A1 1/2004 Stefanutti et al.
2006/0185280 A1* 8/2006 Cretti ..... E04B 5/19 52/309.12
2007/0144093 A1* 6/2007 Messenger ..... E02D 27/02 52/309.12
2007/0210237 A1 9/2007 Stefanutti et al.
(Continued)

FOREIGN PATENT DOCUMENTS

EP 2484840 A4 * 10/2014 ..... E04B 1/762
EP 1621696 B1 * 11/2014 ..... E02D 31/02
(Continued)

*Primary Examiner* — Babajide A Demuren
(74) *Attorney, Agent, or Firm* — Kevin Soules; Kermit Lopez; Luis Ortiz

(57) ABSTRACT

A concrete form panel system and method includes a screen grid insulated concrete form panel for use in a wall system. The screen grid insulated concrete form panel includes a filled concrete thermal mass of the wall system located on an interior face of the wall system with expanded polystyrene insulation on an exterior side of the wall system, which results an enhanced thermal stability and isolation of an interior climate of a structure constructed utilizing the wall system.

16 Claims, 5 Drawing Sheets

(56) References Cited

U.S. PATENT DOCUMENTS

| | | | | |
|---|---|---|---|---|
| 2008/0104912 | A1* | 5/2008 | Au | E04B 2/8629<br>52/309.8 |
| 2009/0064617 | A1 | 3/2009 | Montoya et al. | |
| 2010/0193662 | A1 | 8/2010 | Juen et al. | |
| 2015/0167295 | A1 | 6/2015 | Baader | |

FOREIGN PATENT DOCUMENTS

| | | | | |
|---|---|---|---|---|
| EP | 2799638 | A1 * | 11/2014 | E04B 1/762 |
| EP | 2801676 | A1 * | 11/2014 | E04B 1/762 |
| WO | WO 2015167203 | A1 * | 11/2015 | E04F 15/18 |

* cited by examiner

SCREEN GRID INSULATED CONCRETE FORM PANEL SYSTEM AND METHOD FOR CONSTRUCTION AND BUILDING

CROSS-REFERENCE TO PROVISIONAL APPLICATION

This nonprovisional patent application claims the benefit under 35 U.S.C. § 119(e) and priority to U.S. Provisional Patent Application Ser. No. 62/277,122 filed on Jan. 11, 2016, entitled "Screen Grid Insulated Concrete Form Panel System and Method for Construction and Building," which is incorporated herein by reference in its entirety.

TECHNICAL FIELD

Embodiments are related to concrete forms composed of an insulative material. Embodiments also relate to a screen grid insulated concrete form panel for use in construction and buildings.

BACKGROUND

Concrete forms are utilized as a framework for the construction of concrete structures, such as the walls or floors of a building. Traditional form systems typically entail setting up two spaced apart form panels and pouring concrete into the space created between the panels. After the concrete hardens, the forms are removed, leaving the cured concrete wall. Traditional systems, however, have several drawbacks including the time required to erect the forms, the time for the concrete to cure, and the time to take down the forms making the process expensive and labor-intensive.

Concrete forms, including those made from an insulative material, such as expanded polystyrene foam, have been known for some time. The problem with known forms, however, is that they are often difficult and/or time consuming to stack together or otherwise assemble. Further, known concrete forms for use in the construction of buildings and the like do not incorporate and thus provide an interior surface which can be quickly, easily, and inexpensively finished.

BRIEF SUMMARY

The following summary is provided to facilitate an understanding of some of the innovative features unique to the disclosed embodiments and is not intended to be a full description. A full appreciation of the various aspects of the embodiments disclosed herein can be gained by taking the entire specification, claims, drawings and abstract as a whole.

It is, therefore, one aspect of the disclosed embodiments to provide for an, improved concrete form for use in construction and building.

It is another aspect of the disclosed embodiments to provide for an improved concrete form composed of one or more insulative materials.

It is yet another aspect of the disclosed embodiments to provide for a screen grid insulated concrete form panel for use in construction and buildings.

It is a further aspect of the disclosed embodiments to provide for a square screen grid insulated concrete form panel system.

The aforementioned aspects and other objectives and advantages can now be achieved as described herein. In one example embodiment, a screen grid insulated concrete form panel system can be implemented, which uniquely places the filled concrete thermal mass of the wall system on the interior face of the wall system and expanded polystyrene insulation on the exterior side of the wall system, resulting in superior thermal stability and isolation of the interior climate of the structure built with the system. Such a system creates a thermal break between the exterior of the structure and the concrete thermal mass. Such a system allows for a thermal bridge between the interior of the structure and the concrete thermal mass. The system's interior panel can include a glass mat sheathing that permits thermal transfer into and out of the encapsulated concrete thermal mass. The result is a highly stable interior air temperature that is not affected by fluctuations in the exterior climate. The concrete thermal mass stabilizes the interior air temperature in a tight range by absorbing and dissipating heat.

In another example embodiment, a screen grid insulated concrete form panel system can be implemented, which includes a cavity formed in a foam panel, which is flat on the exterior side and has square shaped cutouts on the inside of the panel to form a cavity in a grid pattern where rebar is placed and concrete is filled.

In yet another example embodiment, a screen grid insulated concrete form panel system can be implemented, which includes a glass mat sheathing sheet for an interior finish substrate in the panel itself, which serves as a form for the concrete and eliminates the need for interior drywall application. In addition to eliminating this construction step, it results in a minimum, for example, one hour fire rating with respect to the wall system. The glass mat sheathing can be installed with an offset in order to assist with the alignment of the subsequent panel which also has, for example, a similar offset. Such a configuration can enable the panels to be quickly stood up and aligned.

In still another example embodiment, a screen grid insulated concrete form panel system can be implemented, which eliminates the need for stacking small blocks to attain a standard ceiling height. The dimensions of such system allow it to be compatible with other building systems commonly used in construction. A large lightweight panel, for example, offers significant advantages over conventional insulated form products including ease of installation, thermal performance, and overall cost of construction since the panels are larger and more complete than conventional insulated concrete forms. The system greatly simplifies the process of insulated concrete form construction making it cost competitive with conventional wood frame construction.

In some example embodiments, the forms can be designed to be stacked at full wall height rather than being stacked like masonry blocks. The panels are lightweight enough to be installed easily and yet have enough mass to maintain their position until they are filled with concrete. The system can include a group of voids configured throughout the panels in a grid pattern that conforms to and exceeds the specifications outlined by the International Code Council for Screen Grid Insulated Concrete Forms.

In still another example embodiment, a screen grid insulated concrete form panel system that uniquely can be produced and installed on the job site drastically reducing the cost of building with the system. Expanded polystyrene panels can be trimmed and glue attached to, for example, the glass mat sheathing sheet. Typically insulated concrete forms are produced in a large expensive centralized factory then inefficiently transported to remote job sites for installation. Producing the large panels on site eliminates one transportation step and one production step drastically reducing the cost of building with the system.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION

The particular values and configurations discussed in these non-limiting examples can be varied and are cited merely to illustrate at least one embodiment and are not intended to limit the scope thereof.

The embodiments will now be described more fully hereinafter with reference to the accompanying drawings, in which illustrative embodiments of the invention are shown. The embodiments disclosed herein can be embodied in many different forms and should not be construed as limited to the embodiments set forth herein; rather, these embodiments are provided so that this disclosure will be thorough and complete, and will fully convey the scope of the invention to those skilled in the art. Like numbers refer to identical, like or similar elements throughout, although such numbers may be referenced in the context of different embodiments. As used herein, the term "and/or" includes any and all combinations of one or more of the associated listed items.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 3:
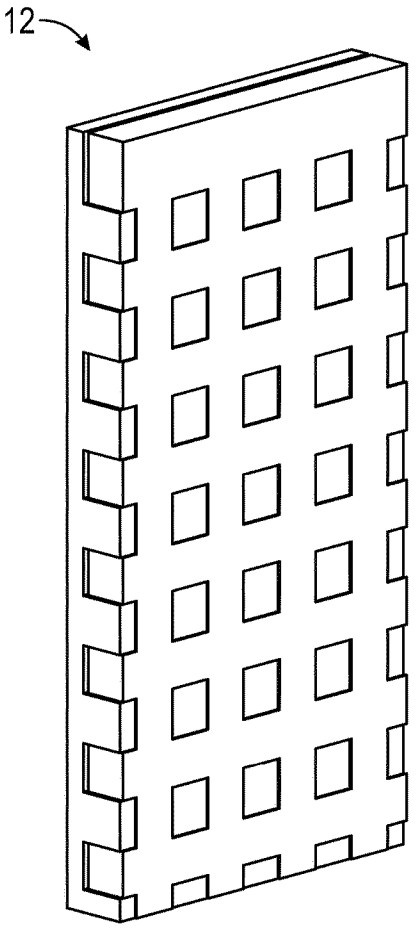
FIG. 3 illustrates a screen grid insulated concrete panel, in accordance with an example embodiment.
Figure 2:
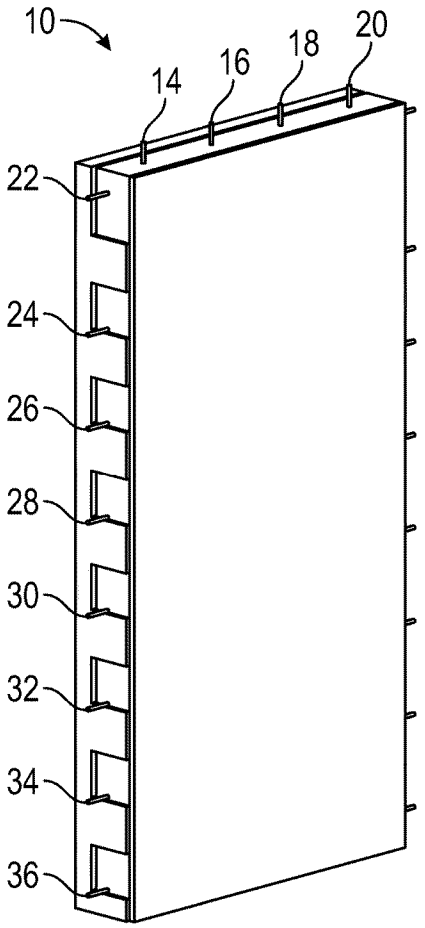
FIG. 2 illustrates an insulated concrete panel protruding rebar, in accordance with an example embodiment.
Figure 1:
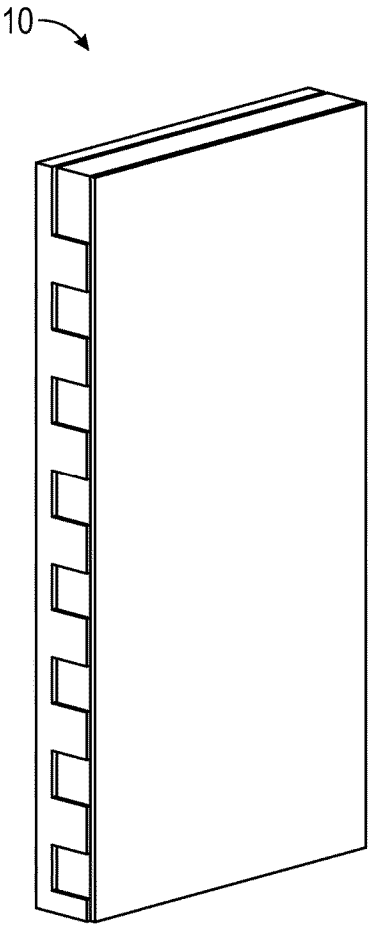
FIG. 1 illustrates an insulated concrete panel, n accordance with an example embodiment.
Figure 4C:
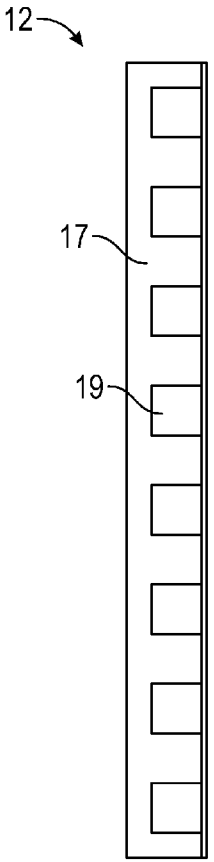
FIGS. 4(*a*) to 4(*f*) illustrate varying side and top views of the screen grid insulated concrete panel shown in FIG. 3, in accordance with an example embodiment.
Figure 4B:
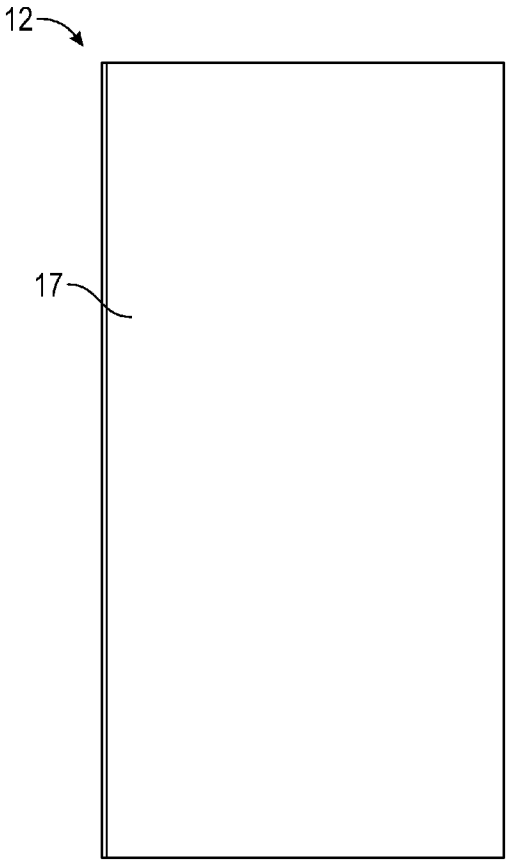
Figure 4A:
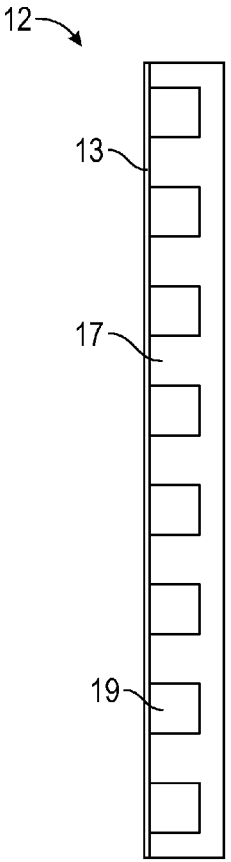
Figure 4F:
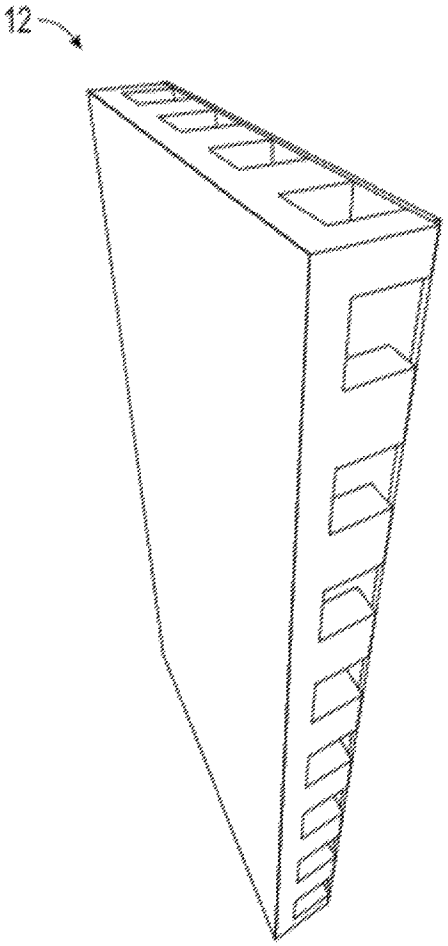
Figure 4E:
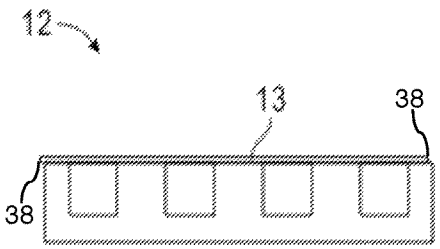
Figure 4D:
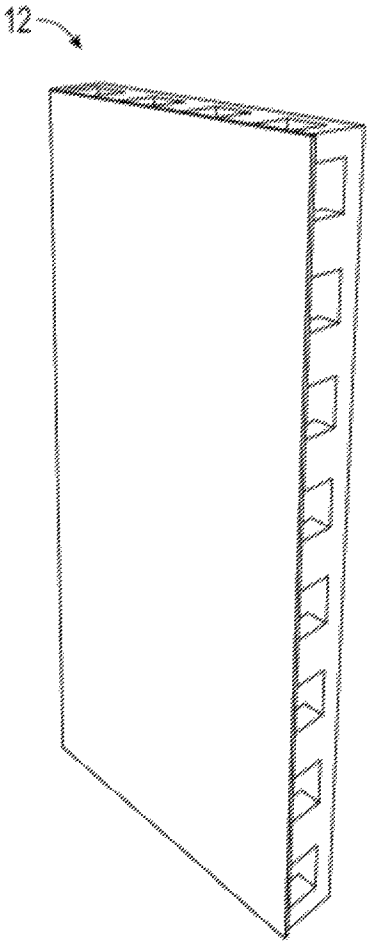
Figure 5A:
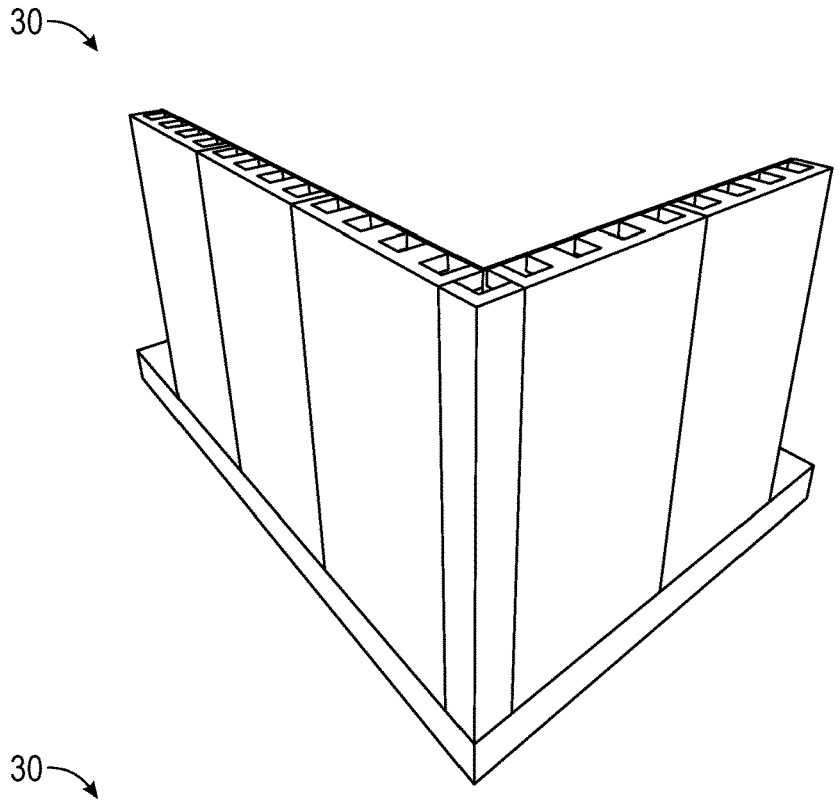
FIGS. 5(*a*) to 5(*d*) illustrate a screen grid insulated concrete panel system in various stages of use and assembly, in accordance with an example embodiment.
Figure 5B:
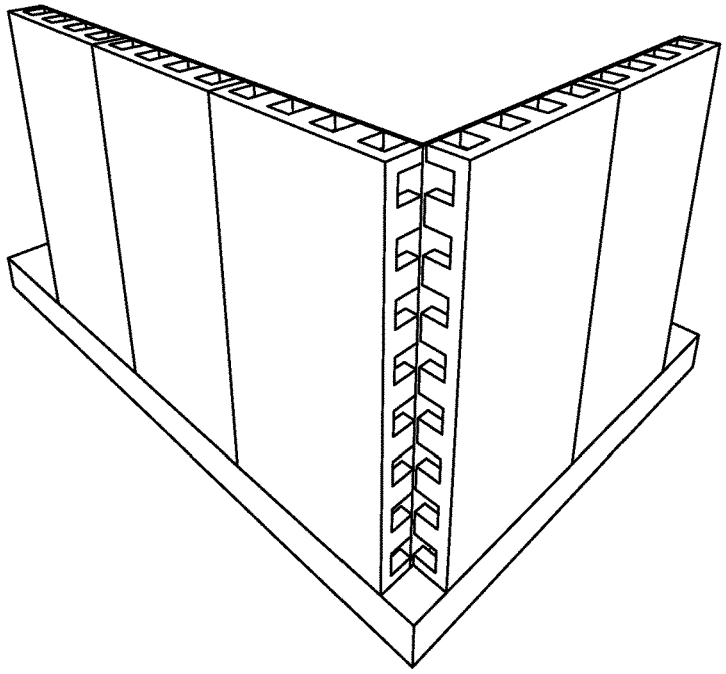
Figure 5C:
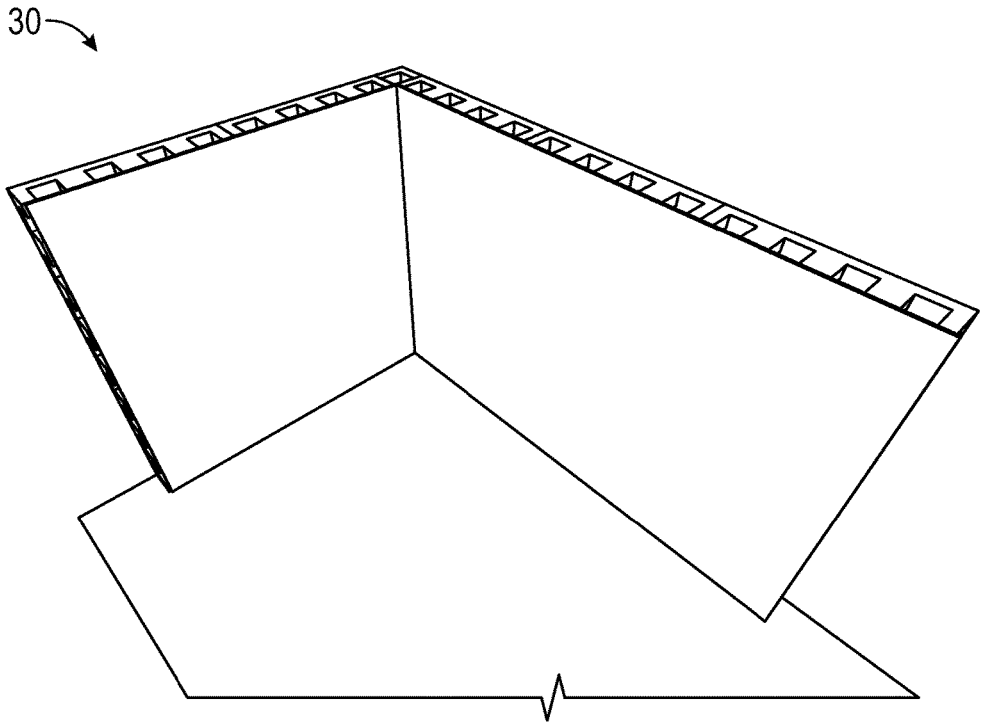
Figure 5D:
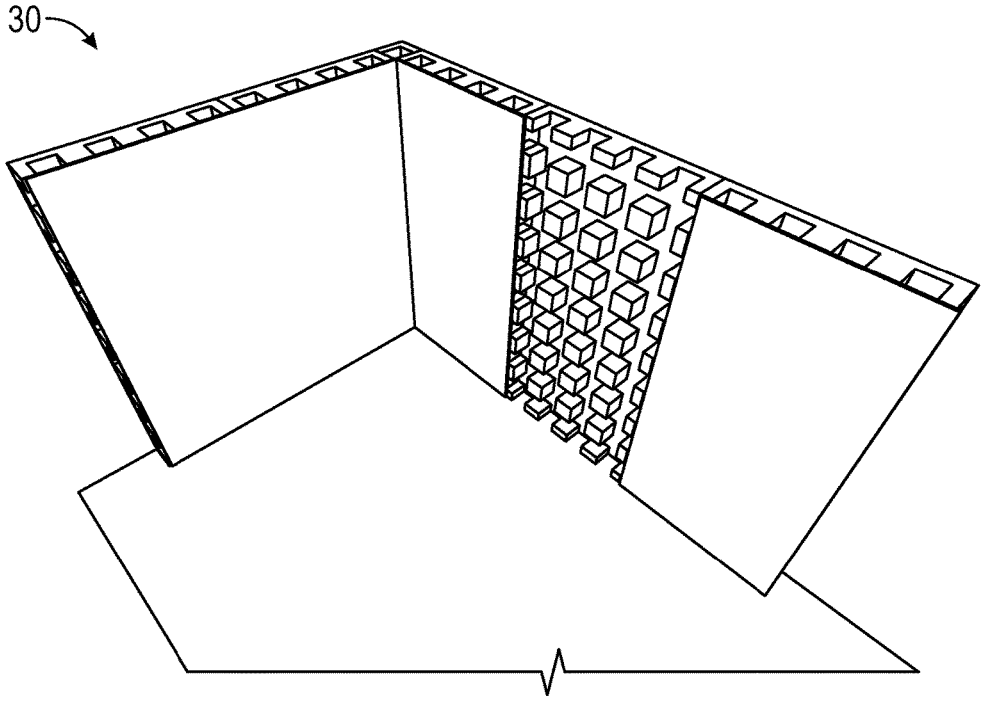

FIG. 1 illustrates an insulated concrete panel 10, in accordance with an example embodiment. FIG. 2 illustrates the insulated concrete panel 18 with protruding rebar 14, 16, 18, 20, 22, 24, 26, 28, 30, 32, 34, and 36, in accordance with an example embodiment. FIG. 3 illustrates a screen grid insulated concrete panel 12, in accordance with an example embodiment. FIGS. 4(*a*) to 4(*f*) illustrate varying side and top views of the screen grid insulated concrete panel 12 shown in FIG. 3, in accordance with an example embodiment. FIGS. 5(*a*) to 5(*d*) illustrate a screen grid insulated concrete panel system 30 in various stages of use and assembly, in accordance with an example embodiment. The screen grid insulated concrete panel system 30 can be composed of a plurality of panels including, for example, one or more panels such as concrete panel 12.

In one example embodiment, a square screen grid insulated concrete form panel system 38 can be implemented, which uniquely places a filled concrete thermal mass of a wall system on the interior face of the wall system and expanded polystyrene insulation on the exterior side of the wall system, resulting in superior thermal stability and isolation of the interior climate of the structure built with the system. Such a system can create a thermal break between the exterior of the structure and the concrete thermal mass. Such a system allows for a thermal bridge between the interior of the structure and the concrete thermal mass. The system's interior panel can be implemented as a glass mat sheathing that permits thermal transfer into and out of the encapsulated concrete thermal mass. The result is a highly stable interior air temperature that is not affected by fluctuations in the exterior climate. The concrete thermal mass stabilizes the interior air temperature in a tight range by absorbing and dissipating heat.

In another example embodiment, a square screen grid insulated concrete form panel system composed of one or more panels such as, for example, panel 12 can be implemented, which includes a cavity formed in a foam panel, which is flat on the exterior side and has square shaped cutouts on the inside of the panel to form a cavity in a grid pattern where rebar is placed and concrete is filled. In some example embodiments, the resulting structure can be composed of, for example, 6 inch×6 inch square concrete posts and beams 12 inches on center with a ½ inch rebar placed in every post and beam. It should be appreciated that such parameters (e.g., 6 inch×6 inch square, 12 inches, ½ inch, etc.) are referred to herein for exemplary purposes only and are not to be considered limiting features of the disclosed embodiments.

The concrete grid pattern can exceed the requirements, of the "SCREEN-GRID ICE" as defined in the International Residential Code and also can create a flat concrete surface on both sides of the wall for anchoring heavy objects to the wall. The square shape of the posts and beams is an important feature of the disclosed embodiments; however, it can be appreciated that other shapes may also be implemented instead of simply a square shape. For example, in some embodiments, the shapes may be circular, rectangular, oval, etc. In general, the selected shapes should enhance the strength and functionality of the wall.

In yet another example embodiment, the square screen grid insulated concrete form panel system 30 can be implemented, which includes, for example, a glass mat sheathing sheet (e.g., a 4 foot×8 foot×⅝" glass mat sheathing sheet) located on the interior finish substrate in each panel itself, which serves as a form for the concrete, thereby eliminating the need for an interior drywall application. In addition to eliminating this construction step, it results in a minimum one hour fire rating on the wall system. A glass mat sheathing is installed with, for example, a ⅝" offset 38 in order to help with the alignment of the subsequent panel which also has, for example, a ⅝" offset. Such a configuration can enable the panels to be quickly stood up and aligned. Again, it should be appreciated that such parameters (e.g., ⅝" offset, etc.) are referred to herein for exemplary purposes only and are not to be considered limiting features of the disclosed embodiments.

In still another example embodiment, a square screen grid insulated concrete form panel system can be implemented, which is, for example, 48 inches wide by 96 inches tall that eliminates the need for stacking small blocks to reach a standard ceiling height. The standard dimensions of the system render it compatible with other building systems commonly utilized in construction projects. The large lightweight panel has significant advantages over conventional, insulated form products including ease of installation, thermal performance, and overall cost of construction since the panels are larger and more complete than conventional insulated concrete forms. The system greatly simplifies the process of insulated concrete form construction making it cost competitive with conventional wood frame construction. Such parameters (e.g., 48 inches wide by 96 inches tall, etc.) are referred to herein for exemplary purposes only and are not considered to be limiting features of the disclosed embodiments.

In some example embodiments, the forms can be designed to be stacked at full wall height rather than being stacked like masonry blocks. The panels are lightweight enough to be installed easily and yet have enough mass to maintain their position until they are filled with concrete. The system can include a number of voids throughout the panels in a grid pattern that conforms to and exceeds the specifications outlined by the International Code Council for Screen Grid Insulated Concrete Forms. An example of such a void is the void 19 shown in FIG. 4(*a*) and FIG. 4(*c*). Note that the panel 12 shown in FIGS. 4(*a*) to 4(*f*) can include, for example, a panel body 17.

In still another example embodiment, a square screen grid insulated concrete form panel system that uniquely can be produced and installed on the job site drastically reducing the cost of building with the system. Expanded polystyrene panels can be trimmed and glue attached to, for example, a ⅝" glass mat sheathing sheet such as the sheet 13 shown in FIGS. 4(*a*) and 4(*d*). Typically insulated concrete forms are produced in a large expensive centralized factory then inefficiently transported to remote job sites for installation. Producing the large panels on site eliminates one transportation step and one production step drastically reducing the cost of building with the system.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art, which are also intended to be encompassed by the following claims.

What is claimed is:

1. A concrete form panel system, comprising:

a screen grid insulated concrete form panel for use in a wall system, said screen grid insulated concrete form panel being configured of foam, and further comprising:

a filled concrete thermal mass of said wall system wherein said filled concrete thermal mass is exposed to an interior of a structure constructed utilizing said wall system;

a cavity formed in said screen grid insulated concrete form panel wherein said cavity is flat on an exterior side of said screen grid insulated concrete form panel and includes square-shaped cutouts on an inside of said screen grid insulated concrete form panel to configure said cavity in a grid pattern wherein rebar is placed, and concrete is filled, to form said filled concrete thermal mass;

an expanded polystyrene insulation on an exterior side of said wall system, which results in an enhanced thermal stability and an isolation of an interior climate of said structure constructed utilizing said wall system;

a glass mat sheathing sheet that serves as a form for the concrete thermal mass; and an offset in said glass mat sheathing configured to assist in alignment of said screen grid insulated concrete form panel in said wall system.

2. The system of claim 1 further comprising:

a thermal break between an exterior of said structure and said filled concrete thermal mass formed by said screen grid insulated concrete form panel.

3. The system of claim 1 wherein said screen grid insulated concrete form panel together, with said wall system, allows for a stable interior air temperature.

4. The system of claim 1 wherein said filled concrete thermal mass stabilizes an interior air temperature in a tight range by absorbing and dissipating heat.

5. The system of claim 1 wherein said glass mat sheathing sheet in said screen grid insulated concrete form panel comprises a surface interior to said structure constructed utilizing said wall system thereby eliminating a need for interior drywall application.

6. The system of claim 1 wherein said glass mat sheathing is a conductor that permits thermal transfer into, and out of, said filled concrete thermal mass.

7. The system of claim 1 wherein said screen grid insulated concrete form panel comprises an insulated concrete form panel with a square screen grid.

8. A concrete form panel system, comprising:

a screen grid insulated concrete form panel for use in a wall system, said screen grid insulated concrete form panel being configured of foam, and further comprising:

a filled concrete thermal mass of said wall system wherein said filled concrete thermal mass is exposed to an interior of a structure constructed utilizing said wall system;

a cavity formed in said screen grid insulated concrete form panel wherein said cavity is flat on an exterior side of said screen grid insulated concrete form panel and includes square-shaped cutouts on an inside of said screen grid insulated concrete form panel to configure said cavity in a grid pattern wherein rebar is placed, and concrete is filled, to form said filled concrete thermal mass;

an expanded insulation on an exterior side of said wall system, which results in an enhanced thermal stability and an isolation of an interior climate of said structure constructed utilizing said wall system;

a glass mat sheathing sheet that serves as a form or the concrete thermal mass; and an offset in said glass mat sheathing configured to assist in alignment of said screen grid insulated concrete form panel in said wall system.

9. The system of claim 8 wherein said expanded insulation comprises expanded polystyrene insulation.

10. The system of claim 8 further comprising:

a thermal break between an exterior of said structure and said filled concrete thermal mass formed by said screen grid insulated concrete form panel.

11. The system of claim 8 wherein said screen grid insulated concrete form panel, together with said wall system, allows for a stable interior air temperature.

12. The system of claim 8 wherein said filled concrete thermal mass stabilizes an interior air temperature in a tight range by absorbing and dissipating heat.

13. The system of claim 8 wherein said glass mat sheathing sheet in said screen grid insulated concrete form panel comprises a surface interior to said structure constructed utilizing said wall system thereby eliminating a need for interior drywall application.

14. A method of configuring a concrete form panel system, said method comprising:

providing a foam screen grid insulated concrete form panel for use in a wall system;

forming a filled concrete thermal mass with a form completed by a glass mat sheathing;

forming a cavity in said screen grid insulated concrete foam panel wherein said cavity is flat on an exterior side of said screen grid insulated concrete foam panel and includes square-shaped cutouts on an inside of said screen grid insulated concrete form panel to configure said cavity in a grid pattern wherein rebar is placed, and concrete is filled, to form said filled concrete thermal mass;

aligning said screen grid insulated concrete form panel with offsets in said glass mat sheathing;

filling said screen grid insulated concrete form panels with concrete;

exposing an interior face of a filled concrete thermal mass of said screen grid insulated concrete form panel associated with said wall system; and insulating an exterior side of said wall system with expanded polystyrene insulation, thereby resulting in an enhanced thermal stability and an isolation of an interior climate of a structure constructed utilizing said wall system.

15. The method of claim 14 further comprising:

creating a thermal break between an exterior of said structure and said filled concrete thermal mass via said screen grid insulated concrete form panel.

16. The method of claim 14 further comprising configuring said screen grid insulated concrete form panel, together with said wall system, to provide a stable interior air temperature.

* * * * *